US012714944B2

(12) United States Patent
Wright

(10) Patent No.: US 12,714,944 B2
(45) Date of Patent: Aug. 25, 2026

(54) HUGGING DOLL

(71) Applicant: Brian A. Wright, Carlsbad, CA (US)

(72) Inventor: Brian A. Wright, Carlsbad, CA (US)

( * ) Notice: Subject to any disclaimer, the term of this patent is extended or adjusted under 35 U.S.C. 154(b) by 224 days.

(21) Appl. No.: 18/645,527

(22) Filed: Apr. 25, 2024

(65) Prior Publication Data

US 2025/0332519 A1 Oct. 30, 2025

(51) Int. Cl.
*A63H 3/02* (2006.01)
*A63H 13/02* (2006.01)

(52) U.S. Cl.
CPC ..... *A63H 3/02* (2013.01); *A63H 13/02* (2013.01)

(58) Field of Classification Search
CPC ..... A63H 3/20; A63H 3/46; A63H 3/48
See application file for complete search history.

(56) References Cited

U.S. PATENT DOCUMENTS 3,053,008 A * 9/1962 Pelunis ..... A63H 13/00 446/330
4,601,671 A * 7/1986 DeMars ..... A63H 3/20 446/330
5,378,188 A * 1/1995 Clark ..... A63H 3/20 446/361
5,651,717 A * 7/1997 Hamilton ..... A63H 3/48 446/362
6,200,190 B1 * 3/2001 Reynolds ..... A63H 3/20 446/376
9,586,153 B2 * 3/2017 Saunders ..... A63H 3/20
2009/0253347 A1 * 10/2009 Byrd ..... A63H 3/20 446/321

* cited by examiner

*Primary Examiner* — Nicholas J. Weiss
(74) *Attorney, Agent, or Firm* — Crockett & Crockett, PC; K. David Crockett, Esq.; Niky Economy Syrengelas

(57) ABSTRACT

A hugging doll equipped with a mechanical hugging apparatus to cause a doll and or stuffed character to return a hug in a lifelike fashion.

5 Claims, 3 Drawing Sheets

HUGGING DOLL

FIELD OF THE INVENTIONS

The inventions described below relate to the field of dolls and stuffed characters.

BACKGROUND OF THE INVENTIONS

Most stuffed toys and dolls are inanimate unless that include complicated and expensive electromechanical components to mimic real life characters.

SUMMARY

The devices and methods described below provide for a simple method and apparatus to cause a doll and or stuffed character to return a hug in a lifelike fashion.

DETAILED DESCRIPTION OF THE INVENTIONS

Figure 1:
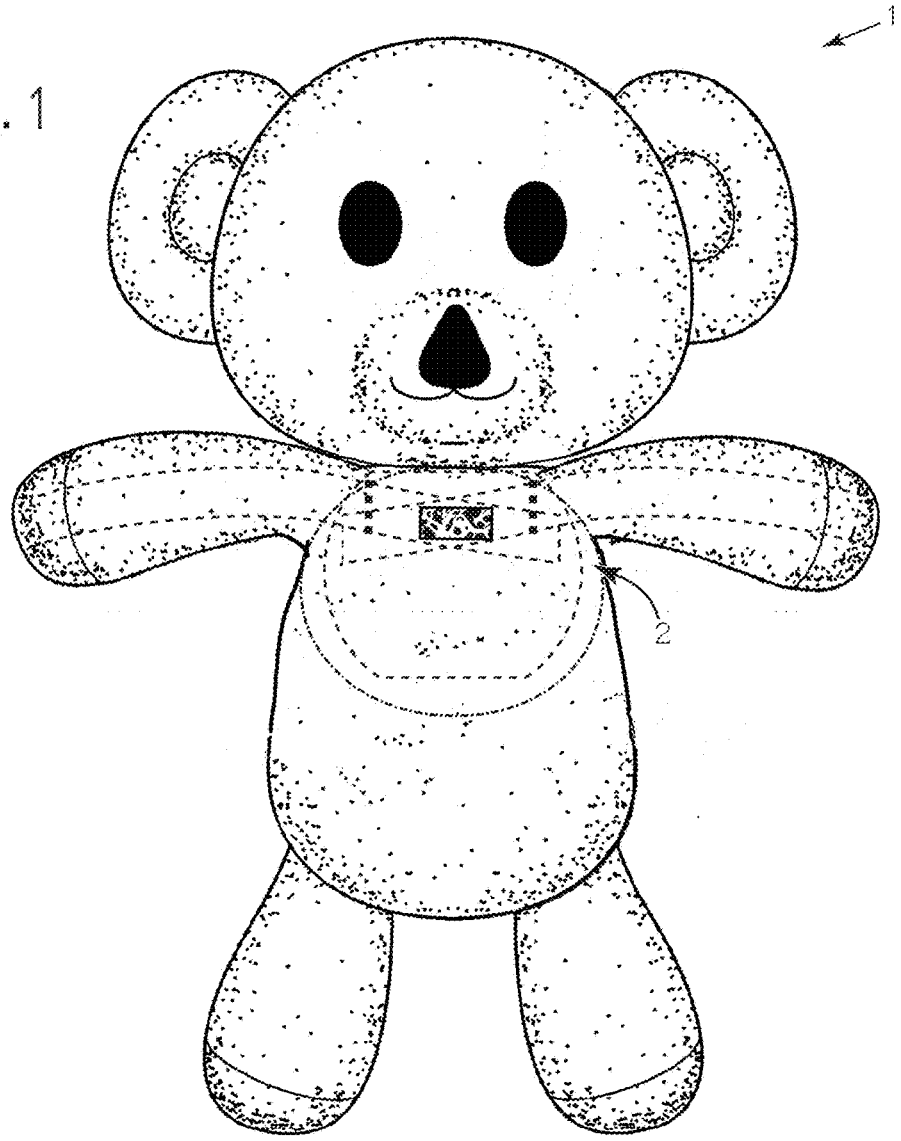
FIG. 1 is a front view of a stuffed bear with the hugging apparatus.

The hugging doll 1 illustrated in FIG. 1 includes a mechanical hugging apparatus or mechanism 2. The mechanical hugging apparatus may be included in any suitable doll, plushie, stuffed figure, toy or animal. Compressing the chest of the hugging doll along the X-axis shown in FIG. 2, for example by hugging the doll to your chest and imparting compression force, will cause the dolls arms to pivot forward simulating a return hug.

Figure 2:
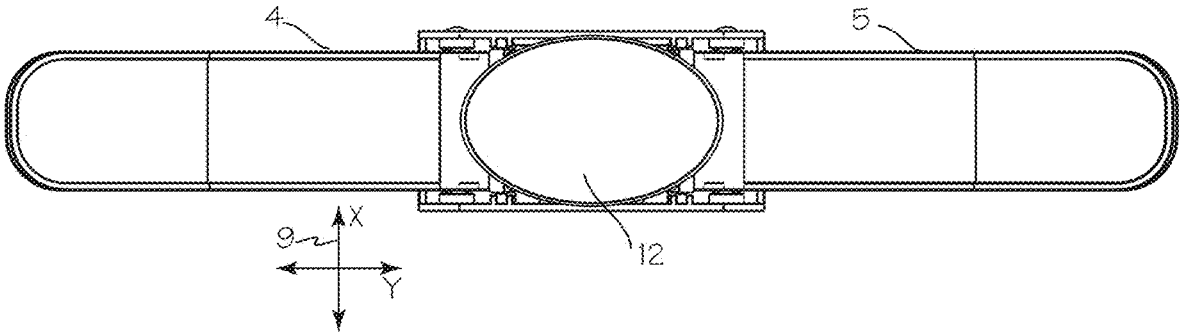
FIG. 2 is a top view of a hugging apparatus assembly.
Figure 3:
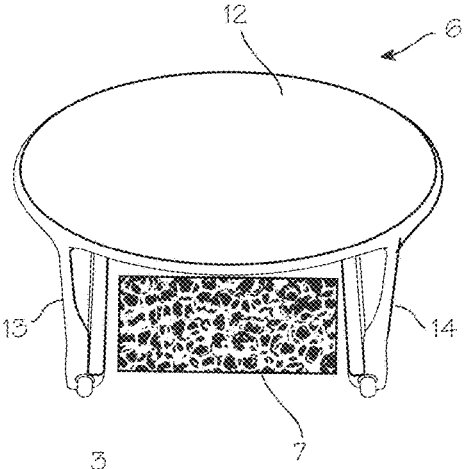
FIG. 3 is a front view of a hugging apparatus front compression plate.
Figure 4:
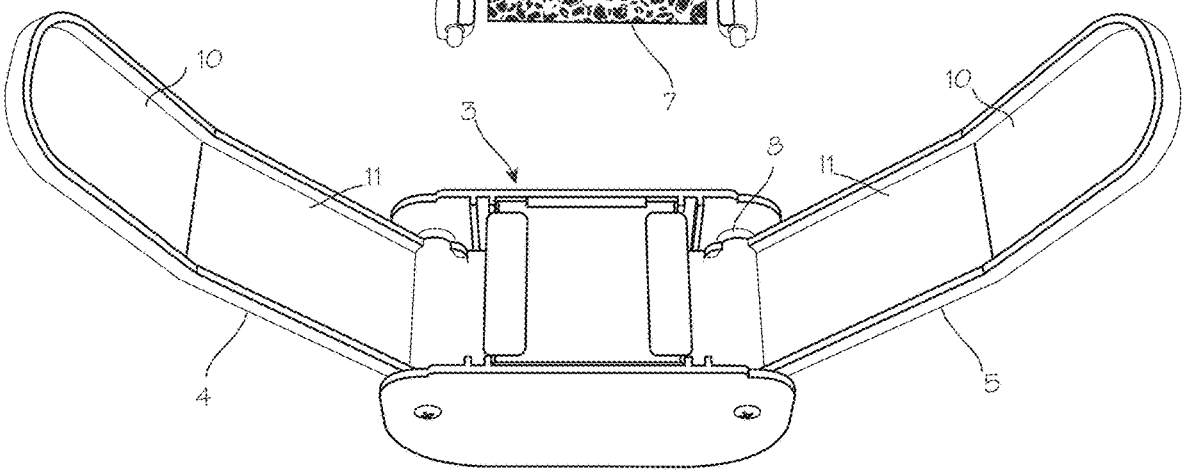
FIG. 4 is a front view of a hugging apparatus rear assembly with arms.

The hugging apparatus is illustrated in FIGS. 2, 3 and 4. The hugging apparatus comprises an assembly including a rear assembly 3 having first 4 and second arms 5, a front compression plate assembly 6 and polyester fiberfill or foam 7 between the rear assembly and the front compression plate assembly. FIG. 3 illustrates the rear assembly which opposes the front compression plate assembly 6. Each of the arms 4, 5 are pivotly connected to the rear assembly via hinges or axles 8 so that the arms are rotatable into an open and closed position. The compression plate assembly is slidably engaged to the arms such that a suitable force applied to the compression plate assembly along the X-axis 9 (seen in FIG. 2) will cause the compression plate to slidabably move along the arms and force horizontal adduction of the arms of the rear assembly towards each other simulating a hugging motion. In order to overcome the open position and move the arms to adduct the arms, a force of at least 1.01b or 4.44822N must be imparted to the front compression plate. Density of fiberfill between 1.3 g/cm$^3$ to 1.5 g/cm$^3$ or 13 to 15 kg/m$^3$. Polyester fiberfill (polyethylene terephthalate or PEY fiberfill) or foam is contained within the space between the rear assembly and the front compression plate. The polyester fiberfill or foam can also be contained inside of the body of the hugging apparatus. The polyester fiberfill is dense enough to exert a force against the front plate so that the front plate is maintained in open position. Alternative synthetic polymers or foam can also be used. The polyester fiberfill is low density, providing lightweight properties ideal for filing the space without adding excessive weight to the stuffed animal. The polyester fiberfill or foam also possesses good resilience so it can recover its original shape after being compressed or deformed.

The arms of the rear assembly include an elongated first section 10 with a second anterior section 11 that is angled from the elongated first section. The arms are pivotaly connected to the rear assembly and maintained in a first open position and rotate to a second closed position when force is exerted on the rear assembly from the front compression assembly.

The compression plate assembly includes a compression surface 12 and first and second legs 13, 14 perpendicularly extending from the compression surface. Each leg has a proximal and distal end and where the proximal end is secured to the compression surface and the distal end extends from the compression surface to slidably engage with the anterior part of the first and second arms of the rear assembly. The distal end of each leg is rounded to slidably move along the anterior section of each arm.

Figure 5:
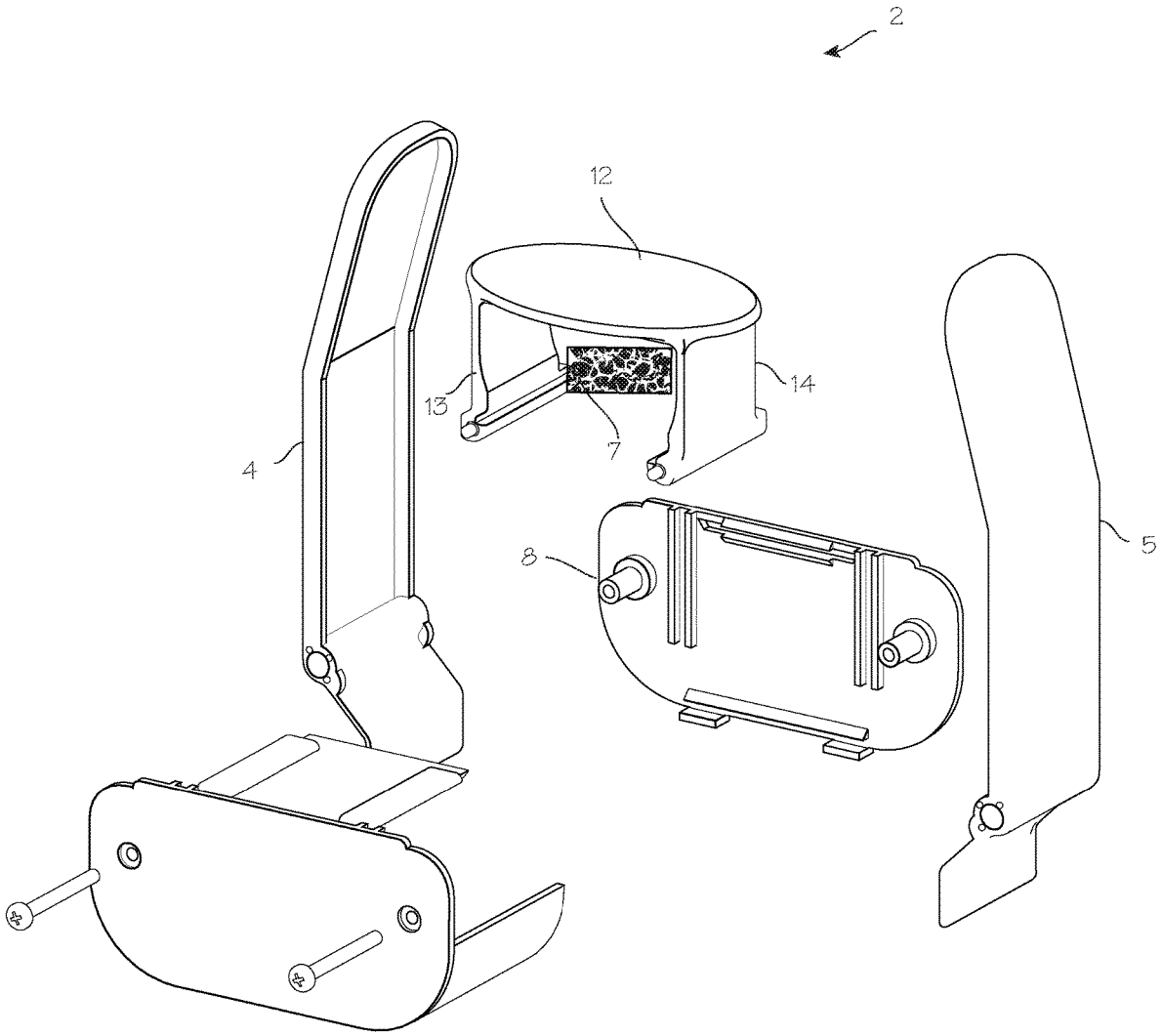
FIG. 5 is an exploded view of the hugging apparatus.

FIG. 5 illustrates an exploded view of the hugging apparatus of the hugging doll. The hugging apparatus comprises a body characterized by a rear assembly 3 having first 4 and second arms 5, a front compression plate assembly 6 and polyester fiberfill 7 between the rear assembly and the front compression plate. The rear assembly includes a housing that rotatably contains the first and second arms at the ends of the housing. The hugging assembly also includes polyester fiberfill or foam between the rear assembly and the front compression plate. The arms rotate around the hinge or axle when a suitable force is exerted on the compression plate. The legs of the front compression plate assembly engage with the anterior part of the first and second arms of the rear assembly and rotate the arms around the hinge to an open position. Insertion of the first and second legs improves the stability of the rear assembly and allows the legs to slide in a guided manner through the rear assembly along the shorter anterior portion of the arm to rotate the arms.

In use, the body is inserted into a plush doll with the rear assembly and the front compression plate in apposition to each other and with polyester fiberfill or foam contained between them. The first and second arms of the rear assembly are each inserted through the arms of the plush toy to cause movement of the arms and are secured within the arms to enable movement of the arms. In a first position, the force of the polyester fill against the rear assembly maintains the arms of the rear assembly in an open position. A user may exert a compressive force against the compression surface of the compressive assembly to engage with the anterior part of the first and second arms of the rear assembly and rotate the arms around the hinge to a second or closed position. The compressive force exerted is strong enough to move the arms of the compressive face and also compress the polyester fiberfill or foam and rotate the arms of the rear assembly. The pressure or force applied to the arms causes the distal ends of the arms to move toward each other to the closed position, mimicking a hugging action in the arms of the plush toy.

While the preferred embodiments of the devices and methods have been described in reference to the environment in which they were developed, they are merely illustrative of the principles of the inventions. The elements of the various embodiments may be incorporated into each of the other species to obtain the benefits of those elements in combination with such other species, and the various beneficial features may be employed in embodiments alone or in combination with each other. Other embodiments and configurations may be devised without departing from the spirit of the inventions and the scope of the appended claims.

I claim:

1. A hugging doll comprising:

a doll configured to enclose a hugging device comprising:

a rear assembly having a housing with opposing first and second ends, and a first arm and a second arm pivotally secured to the first and second ends of the housing, respectively, and rotatably connected to hinges on the rear housing assembly, each of the arms includes a first elongated section and a second anterior section;

a front compression plate assembly having a compression surface and first and second legs perpendicularly extending from the compression surface, the front compression plate assembly apposing the rear assembly; and a polyester fiberfill or foam between the rear assembly and the front compression plate assembly;

wherein in a first position the arms of the rear assembly are in an open position and wherein a second position the legs of the front compression plate assembly engage with the anterior part of the first and second arms of the rear assembly and rotate the arms around the hinges to a closed position.

2. The hugging doll of claim 1 wherein the density of the polyester fiberfill or foam is between 1.3 to 1.5 g/cm$^3$.

3. The hugging doll of claim 2 wherein the rear assembly comprises a first support plate and a second support plate, the second support plate including at least two hinges and at least two protruding arms.

4. The hugging doll of claim 2 wherein the front compression plate comprises a compression surface and first and second legs perpendicularly extending from the compression surface.

5. The hugging doll of claim 4 wherein the legs include a proximal and a distal end and are rounded at the distal end.

* * * * *